US008341995B2

(12) United States Patent
Turner

(10) Patent No.: US 8,341,995 B2
(45) Date of Patent: Jan. 1, 2013

(54) METHOD FOR MAKING CAN BODIES HAVING AXIAL RIBS AND STEP SHOULDER BOTTOMS

(75) Inventor: Stephen B. Turner, Centerville, OH (US)

(73) Assignee: Alfons Haar, Inc., Springboro, OH (US)

( * ) Notice: Subject to any disclaimer, the term of this patent is extended or adjusted under 35 U.S.C. 154(b) by 248 days.

(21) Appl. No.: 12/761,571

(22) Filed: Apr. 16, 2010

(65) Prior Publication Data

US 2011/0252858 A1 Oct. 20, 2011

(51) Int. Cl.
*B21D 1/00* (2006.01)

(52) U.S. Cl. ..... 72/349

(58) Field of Classification Search ..... 72/347, 72/348, 349

See application file for complete search history.

(56) References Cited

U.S. PATENT DOCUMENTS

| | | | |
|---|---|---|---|
| 3,472,418 | A | 10/1969 | Ullman |
| 3,495,736 | A | 2/1970 | Ragettli |
| 4,331,014 | A | 5/1982 | Miller et al. |
| 4,522,049 | A | 6/1985 | Clowes |
| 4,584,859 | A | 4/1986 | Saunders |
| 5,160,031 | A | 11/1992 | Palisin, Jr. et al. |
| 5,267,685 | A | 12/1993 | Sorensen |
| 5,279,442 | A | 1/1994 | Jentzsch et al. |
| 5,699,932 | A | 12/1997 | Claydon et al. |
| 5,727,414 | A | 3/1998 | Halasz et al. |
| 5,899,355 | A | 5/1999 | Claydon et al. |
| 5,938,389 | A | 8/1999 | Shore et al. |
| 6,038,910 | A | 3/2000 | McClung |
| 6,126,034 | A | 10/2000 | Borden et al. |
| 6,374,657 | B1 | 4/2002 | Kirk et al. |
| D495,597 | S | 9/2004 | Rubalcava et al. |
| 7,000,445 | B2 * | 2/2006 | Hepner et al. ..... 72/349 |
| 7,191,632 | B2 * | 3/2007 | Kanehara et al. ..... 72/342.8 |

FOREIGN PATENT DOCUMENTS

| | | | |
|---|---|---|---|
| EP | 0425124 | A1 | 5/1991 |
| GB | 2259075 | A | 3/1993 |
| JP | 60092028 | A | 5/1985 |
| WO | 9625256 | A1 | 8/1996 |

OTHER PUBLICATIONS

Cano, Palmero, A.; International Search Report and Written Opinion of the International Searching Authority; International Application No. PCT/US2011/032018; Jul. 19, 2011; European Patent Office.

* cited by examiner

*Primary Examiner* — Faye Francis
(74) *Attorney, Agent, or Firm* — Stevens & Showalter LLP

(57) ABSTRACT

A method for forming at least one rib and a step shoulder bottom of a can body in a single drawing operation from a redrawn cup or preform which has a closed end with an inwardly tapering annular periphery that includes sufficient material to enable formation of the step shoulder bottom without having the at least one rib drawn into the step shoulder bottom.

20 Claims, 5 Drawing Sheets

METHOD FOR MAKING CAN BODIES HAVING AXIAL RIBS AND STEP SHOULDER BOTTOMS

BACKGROUND OF THE INVENTION

1. Field of the Invention

The present invention relates to can bodies having one or more axial beads or ribs formed in their side walls and also having step shoulder bottoms. More particularly, the present invention relates to a method for forming at least one rib and a step shoulder bottom of a can body in a single drawing operation from a redrawn cup which has a closed end with an inwardly tapering annular periphery including sufficient material to enable formation of the step shoulder bottom without having the at least one rib drawn into the step shoulder bottom.

2. Description of the Related Technology

Ribs or beads in the side walls of can bodies formed, for example, to enhance the appearance of a can and/or to add side wall strength for supporting axially applied loads, are known in the art.

Similarly known is the formation of can bodies using draw-redraw forming techniques wherein a first draw is performed to create a cup having a first diameter and height and a second draw or redraw is performed using a punch and redraw die. The cup is placed over an annular cup-holding member or redraw pad and the closed bottom of the cup is held by the redraw pad and a flat face portion of the redraw die. The redraw pad is moved synchronously with the redraw die. The relative movement of the punch and the redraw die extends the cup to form a deeper cup having a reduced second diameter and a reduced side wall thickness. During the redraw operation, the draw pad and the flat face portion of the redraw die act as a holding face which influences the plastic flow of the cup material as it is redrawn.

Cans used for packaging food and other products may have a bottom configuration that includes a step shoulder defined by an outwardly extending annular projection in the outer circumferential area of the bottom closely adjacent to the can side wall. The can bottoms may also have one or more concentric beads spaced radially inward from the step shoulder.

A problem that may be encountered when using draw-redraw forming techniques to form cans having step shoulders and axial ribs or beads in the side wall is that the axial ribs tend to be drawn into the step shoulder. For aesthetic and other reasons, drawing the axial ribs into the step shoulder is unacceptable. U.S. Pat. No. 6,374,657 discloses a manufacturing process for cans having a bottom with a step shoulder, referred to in the '657 patent as a bump-up bottom, and axial side wall ribs that ensures ample material in the bottom area of a can body preform so as to prevent the side wall ribs from being drawn into the step shoulder by providing a cup with a recessed bottom.

The '657 patent teaches two alternate two step processes. In the preferred process, the first step is a first drawing operation that creates a cup having a side wall that has at least one axially extending rib or bead formed therein and a bottom that is coextensive with the side wall and intersects the side wall at a rim. The first step is performed so that at least a portion of the bottom is recessed by a predetermined depth with respect to the rim. The second step is a second drawing operation performed on the cup to form a can body having a step shoulder or bump-up bottom wherein the predetermined depth of the recessed bottom of the cup is sufficient to prevent the at least one axially extending rib from being drawn into the bump-up bottom.

In an alternate process of the '657 patent, the first step is providing a cup having a sidewall and a bottom that is coextensive with the sidewall and intersects the sidewall at a rim, the first step being performed so that at least a portion of the bottom is recessed by a predetermined depth with respect to the rim. The second step is performing a forming operation on the cup to form a can body having at least one axial rib defined in its sidewall and having a bump-up bottom, and wherein the predetermined depth of the recessed bottom of the cup is sufficient so as to prevent the at least one axially extending rib from being drawn into the bump-up bottom during the second step.

SUMMARY OF THE INVENTION

In accordance with the present invention, a method is provided for forming at least one rib and a step shoulder bottom of a can body in a single drawing operation from a redrawn cup or preform which has a closed end with an inwardly tapering annular periphery that includes sufficient material to enable formation of the step shoulder bottom without having the at least one rib drawn into the step shoulder bottom.

In accordance with one aspect of the invention of the present application, a method of making a can body having at least one axial rib and a bottom including a step shoulder comprises placing a cup having a first depth and a closed end over a center block of a redraw die, the closed end of the cup having an inwardly tapering annular periphery. Relative movement of a punch assembly including at least one axial bead punch over the center block forms at least one axial bead in a side wall of the cup. The relative movement of the punch assembly and the center block also forms the cup to have a second depth greater than the first depth and greater than a finished, third depth of the can body and forms the cup to have a step shoulder. Forming the cup to have a step shoulder comprises drawing metal from the inwardly tapering annular periphery of the cup, and collapsing the cup depth from the second cup depth to the third can body depth, metal drawn from the inwardly tapering annular periphery of the cup together with metal from collapsing the cup depth from the second cup depth to the third can body depth are sufficient to prevent the at least one axially extending side wall bead from extending into the step shoulder.

In accordance with another aspect of the invention of the present application, a method of making a can body comprises providing a preform having a first depth and a closed end, the closed end of the preform having an inwardly tapering annular periphery. The preform is placed on a center block having an end panel die. A punch assembly having a cavity for receiving the preform on the center block is provided, the punch assembly having at least one axial bead punch in a sidewall of the cavity and an end panel punch. The punch assembly and the center block are moved relative to one another so that the preform and center block are received in the cavity. The punch assembly and the center block are further moved relative to one another toward a bottomed position of the punch assembly to draw the preform to form at least one bead in a sidewall thereof and to extend the first depth to a second depth greater than the first depth. The punch assembly is bottomed on the center block to form an end panel having a step shoulder by drawing material from the annular periphery of the preform and by collapsing the preform from the second depth to a third depth of the can body.

DETAILED DESCRIPTION OF THE INVENTION

Figure 1:
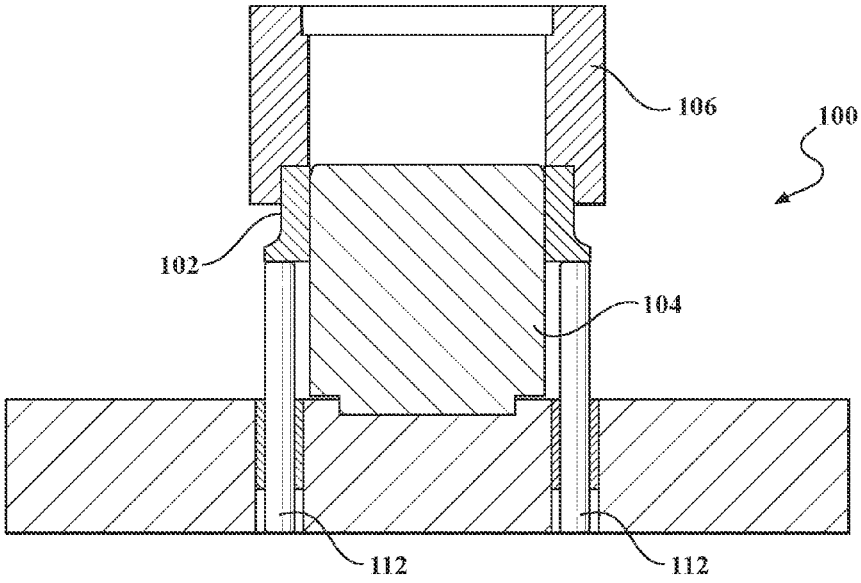
FIGS. 1 and 2 illustrate operation of a press assembly used to transform a cup into a redrawn cup (preform or step shoulder preform) in accordance with one aspect of the present invention.
Figure 2:
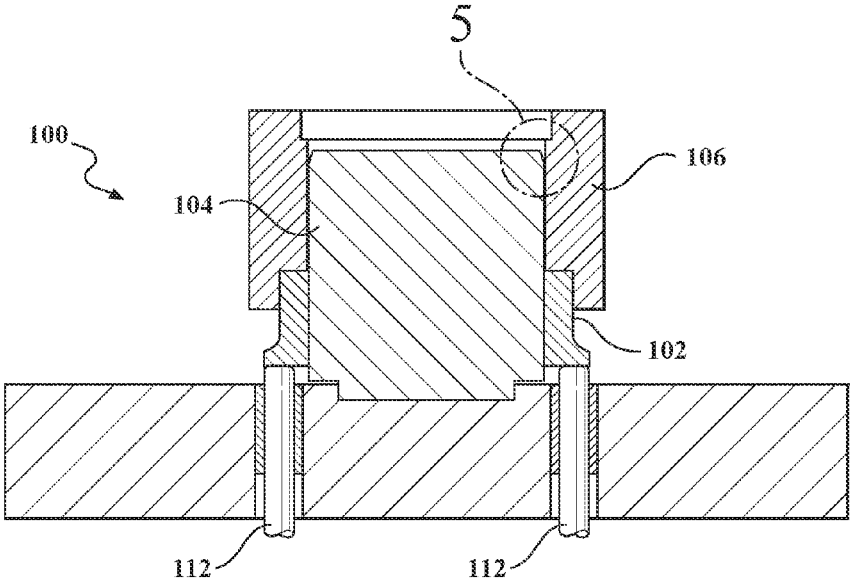
Figure 3:
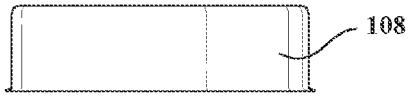
FIGS. 3 and 4 show the cup and redrawn cup, respectively, formed by operation of the press assembly of FIGS. 1 and 2.
Figure 4:
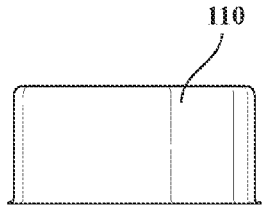

Reference is made to the drawings wherein FIGS. 1 and 2 show an illustrative embodiment of formation of a redrawn cup or preform in accordance with one aspect of the invention of the present application. In FIGS. 1 and 2, a press assembly 100 includes a draw pad 102 which surrounds a center block 104 and a redraw punch 106 with relative movement between the redraw punch 106 and the center block 104 being illustrated by the redraw punch 106 moving down over the center block 104 from FIG. 1 to FIG. 2. A cup 108, as shown in FIG. 3, fits over the draw pad 102 and center block 104 so that it is between the draw pad 102 and the redraw punch 106 as the two are moved relative to one another. As the redraw punch 106 moves over the center block 104, a redrawn cup 110 as shown in FIG. 4 is formed over the center block 104. The redrawn cup 110 may also be referred to as a "preform" or a "step shoulder preform" and all these terms should be considered to be equivalent and interchangeable herein.

The material tensile flow is controlled by the force applied to the draw pad 102 by pressure pins 112 which transfer a force from an air loaded piston or draw cushion (not shown). The material flow is also controlled by radii of the draw pad 102 and the redraw punch 106 as they restrict the flow of material. The larger the radius, the easier for material to flow and the smaller the radius, the more restriction and hence the harder it is for material to flow. For formation of a can body CB shown in FIG. 6, a draw continues until the redrawn cup 110 has reached a height of approximately 43.1 mm. The redrawn cup height of 43.1 mm is approximately 1.3 mm greater than the height of the finished can body CB. As will be explained herein, during formation of a step shoulder bottom panel, the extra cup height is "folded" back into the step shoulder bottom panel of the finished can body CB.

The shape of the redrawn cup 110 of the present application enables formation of can bodies having axial ribs and step shoulder bottom panels in a single drawing operation without having the axial ribs drawn into the step shoulder bottom. More particularly, the shape of the corner of the closed end of the redrawn cup 110 enables the formation of can bodies having axial ribs and step shoulder bottom panels. If there is too much material present in the corner of the closed end of the redrawn cup 110, wrinkles or puckers will be formed in the step shoulder of the bottom panel due to the excess material. If not enough material is present in the corner of the closed end of the redrawn cup 110, the step shoulder of the bottom panel will fracture. The shape of the redrawn cup 110 or step shoulder preform and amount of excess redraw height required are dependant on both the panel configuration and the material used for forming the can body CB. Accordingly, the shape of the corner of the closed end of the redrawn cup 110 must be determined for each can body to be produced based on the panel including the step shoulder to be formed and the material to be used to form the can body.

Figure 5:
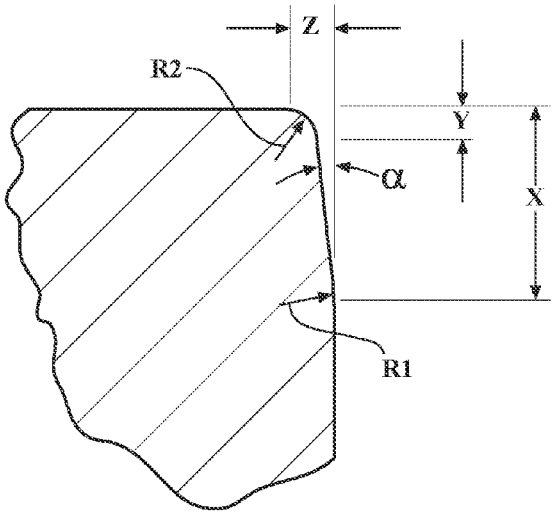
FIG. 5 shows in cross section the upper corner of a center block that forms an inwardly tapering annular periphery of the closed end of the redrawn cup.

The shape of the redrawn cup 110 is determined during the redraw operation illustrated in FIGS. 1 and 2 and the shape of the corner of the closed end of the redrawn cup 110 conforms substantially to the upper corner of the center block 104 that is shown in FIG. 5 and has a defined thickness substantially equal to the thickness of the stock material used to form the redrawn cup 110. The upper corner of the center block 104 as shown in FIG. 5 is defined by two radii R1, R2, and 3 linear dimensions X, Y and Z. For determination of an acceptable redrawn cup 110 including the shape for the corner of the closed end of the redrawn cup 110, one starts with the finished can dimensions.

Using conventional geometrical calculations on a model of a can body to be produced, a determination of the volume of material in the bottom profile can be determined. The material includes the bottom panel BP and the step shoulder SS area extending approximately from the start of the radius R1 on the side wall SW of the can body CB that goes into the step shoulder SS shown by the cut line CL of FIG. 5A, also see FIG. 6. The starting position of the angle defined by the radius R1, i.e., the dimension X, and the offset Z from the sidewall to the top of the center block 104 are varied until the volume of material that will result from formation about the upper corner of the center block 104 is substantially equal to the volume of material required for the can body CB to be produced. The resulting closed end of the redrawn cup 110 can be described as being an inwardly tapering annular periphery.

Figure 5A:
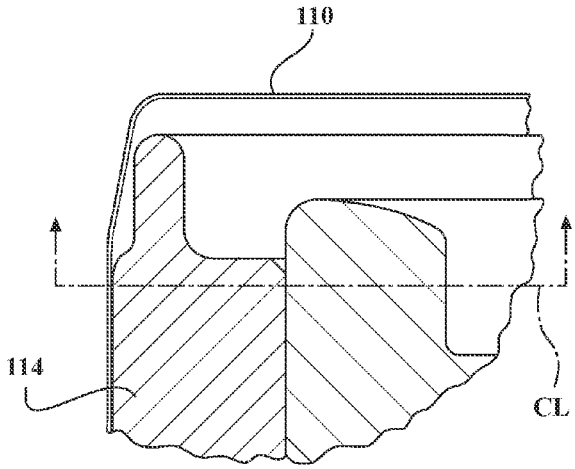
FIG. 5A shows in cross section the spaced relationship between the upper corner of a redrawn cup formed by operation of the press assembly of FIGS. 1 and 2 and a step shoulder form of a center block of a press assembly used to form a can body from the redrawn cup.

An additional requirement of the closed end of the redrawn cup 110 is that the angle a be such that the closed end of the redrawn cup 110 clears the highest edge of a step shoulder form 114, see FIG. 5A. If the redrawn cup 110 contacts the highest edge of the step shoulder form 114, the material between the point of contact and the side wall of the redrawn cup 110 is restricted from moving into the bottom panel BP resulting in possible fracture of the bottom panel BP. If the redrawn cup 110 is spaced too far from the highest edge of the step shoulder form 114, there will be too much material so that wrinkles or puckers will form in the step shoulder.

Figure 6:
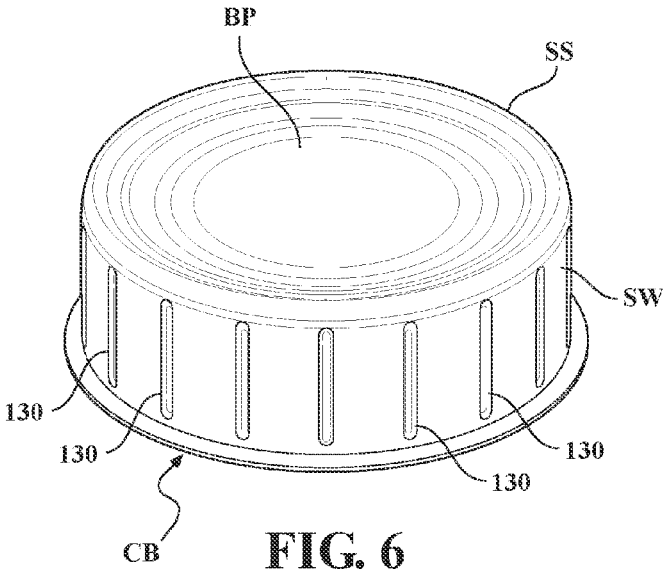
FIG. 6 is a perspective view of a can body having axial ribs and a step shoulder bottom formed in accordance with the present invention.

The embodiment described and illustrated by the can body CB in FIG. 6 has an inside diameter (ID) of approximately 83.5 mm and a finished height of approximately 41.8 mm. The corresponding dimensions for an exemplary upper corner of the center block 104 as illustrated in FIG. 5 are: R1=1.0 mm; R2=0.8 mm; X=4.8 mm; Y=0.8 mm; and Z=1.45 mm. In a working embodiment of the invention of the present application, the can body CB was made from double reduced steel stock material having a thickness of 0.14 mm. It is noted that R1 and R2 must be within a range of approximately 0.8 mm to approximately 1.0 mm for formation of can bodies from such thin stock. Also, in forming processes designed to use double reduced steel, effort is made to minimize the thinning of the material since double reduced steels behave very differently than typical steels when being drawn. That is, they do not stretch uniformly over a large portion, but stretch only over very localized regions which can lead to extreme thinning and metal fracture.

Figure 7:
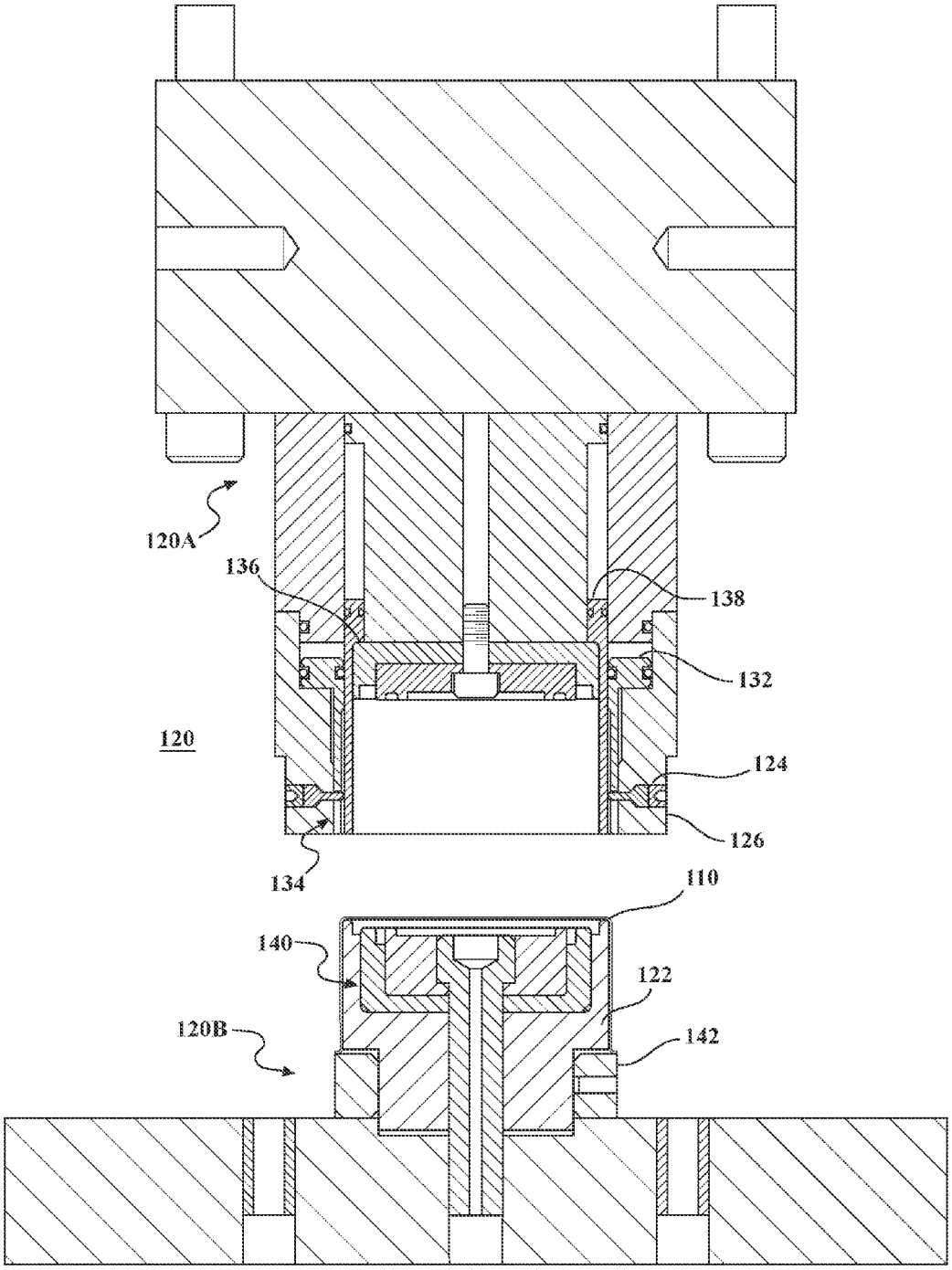
FIGS. 7 and 8 are sectional side views of a press assembly illustrating operation of a press assembly to transform the redrawn cup of FIG. 4 into the can body of FIG. 6, FIG. 7 showing the press assembly in an open position with the redrawn cup or preform on a center block of the press assembly and FIG. 8 showing the press assembly with an upper punch assembly of the press assembly fully bottomed on a lower die assembly of the press assembly.
Figure 8:
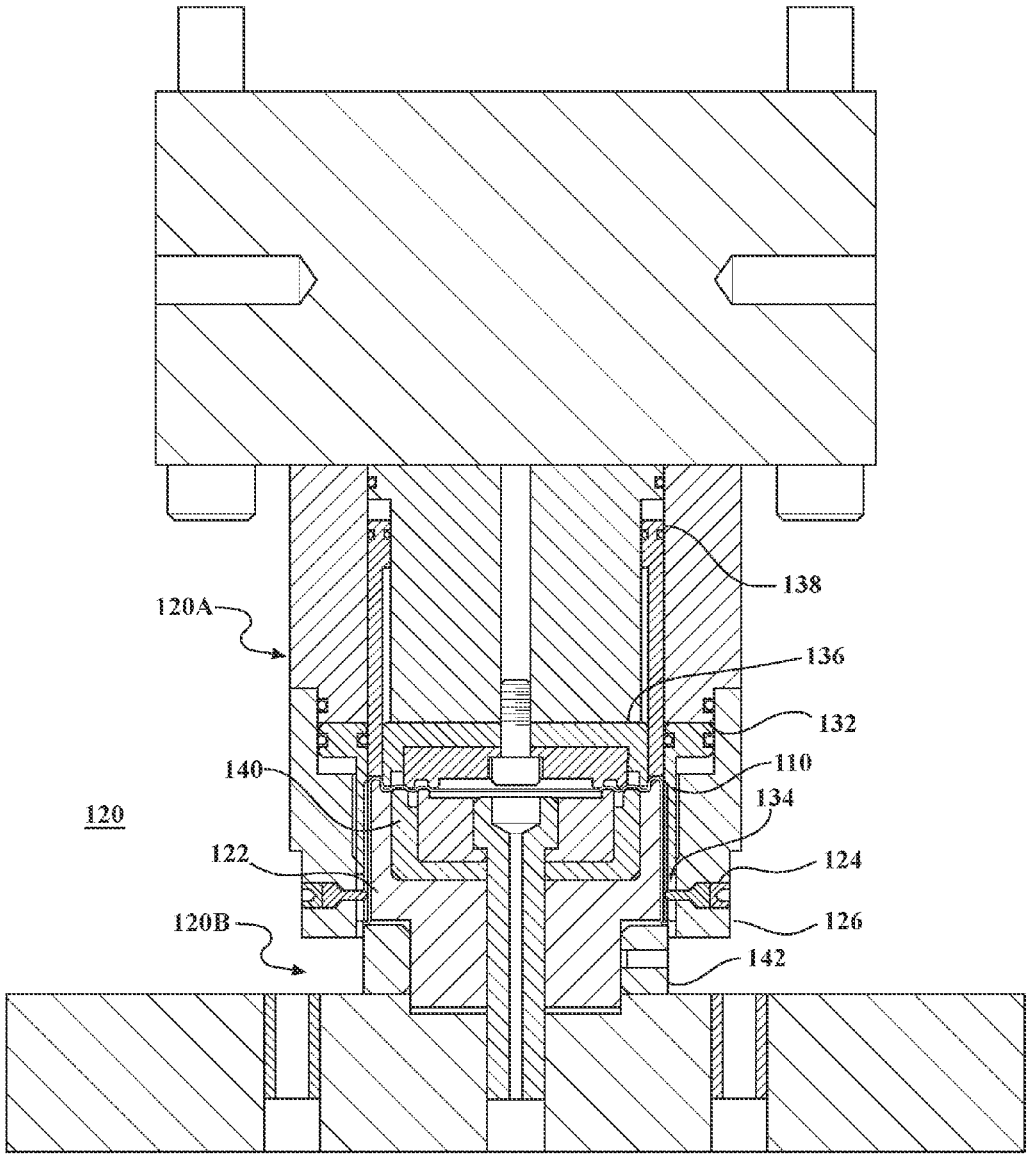
Figure 9:
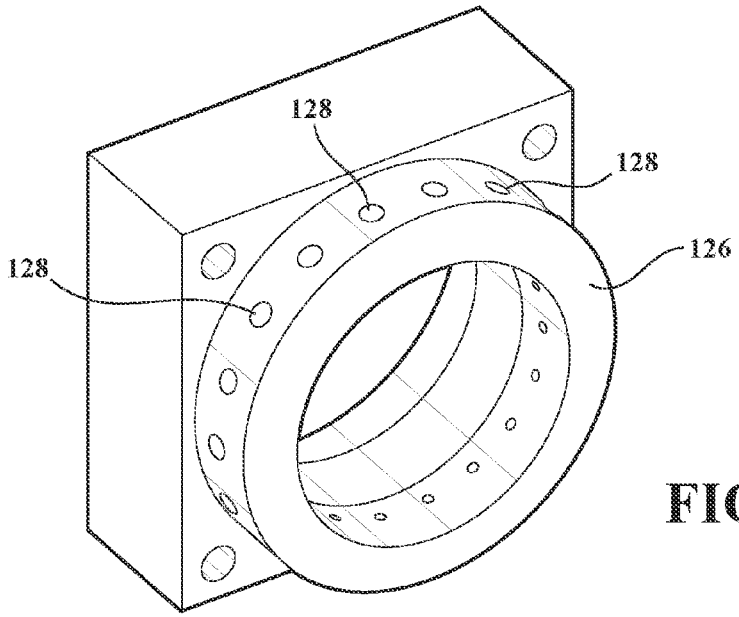
FIG. 9 is a perspective view of a trim punch of the press assembly of FIGS. 7 and 8 showing openings or bores that can receive an axial bead punch(es) for forming an axial rib(s) in can bodies formed in accordance with the present invention.
Figure 10:
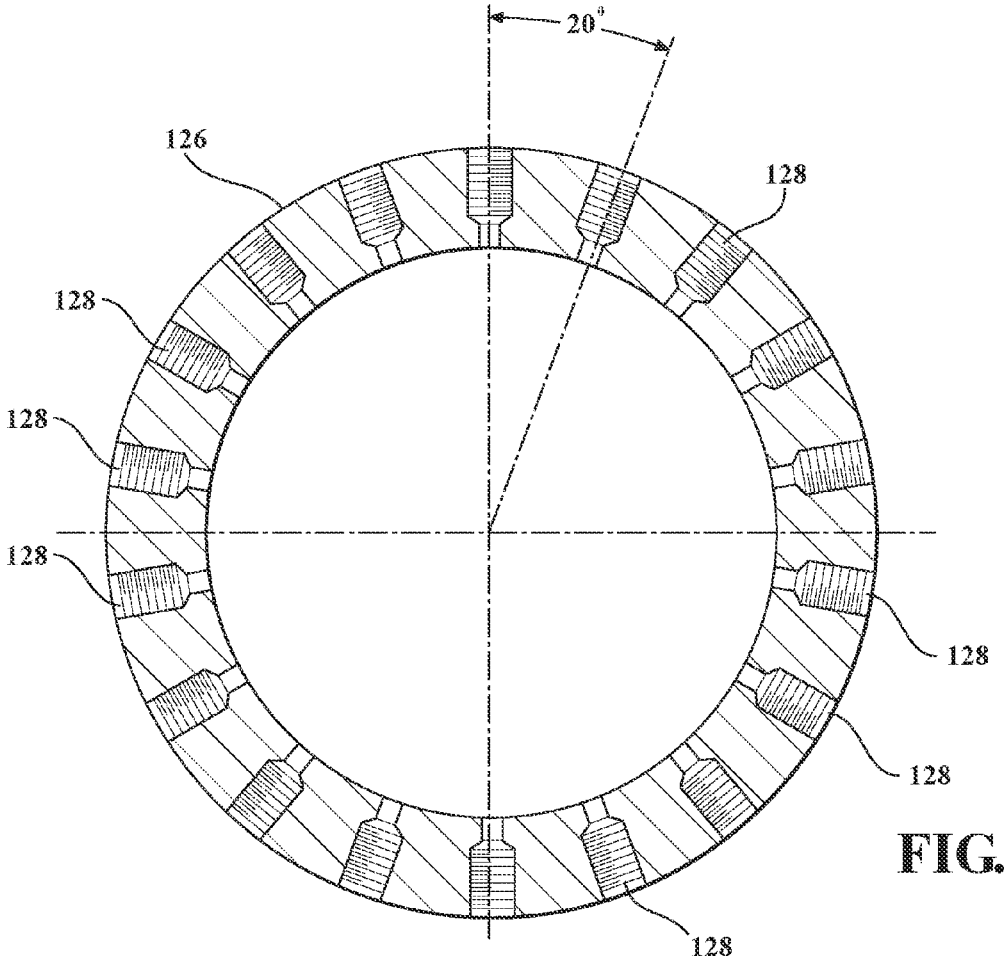
FIG. 10 is a cross sectional view of the trim punch of FIG. 9 taken through the centers of the openings or bores that can receive axial bead punches.

Formation of a can body can be performed using a press assembly for example as illustrated in FIGS. 7 and 8. FIG. 7 shows a press assembly 120 including an upper punch assembly 120A and a lower die assembly 120B. For formation of a can body, a redrawn cup 110 is located on a center block 122. The upper punch assembly 120A is moved downward toward its bottomed position shown in FIG. 8. As the upper punch assembly moves downward over the center block 122, at least one axial bead punch 124 mounted in one of a plurality of bores 128 in a trim punch 126 forms at least one longitudinal or axial bead 130, see FIG. 6, in the side wall of the can body CB. The trim punch 126 is also shown in FIGS. 9 and 10. As illustrated, the upper punch assembly also comprises a stripper 132 that includes recesses 134 through which the bead punch(es) 124 extend, a panel punch 136 and an ejector or knockout 138. The panel punch 136 operates with a panel die 140 to form the bottom panel BP shown in FIG. 6. The trim punch 126 trims excess material from a flange of the can body CB as the trim punch passes over a trim block 142.

While the invention of the present application is believed to be apparent from the foregoing description, for sake of clarity, methods in accordance with aspects of the invention of the present application for making can bodies having at least one axial rib and bottoms including step shoulders will now be described. A method of making a can body having at least one axial rib and a bottom including a step shoulder in accordance with one aspect of the invention of the present application may comprise placing a cup having a first depth and a closed end over a center block of a redraw die, the closed end of the cup having an inwardly tapering annular periphery; relatively moving a punch assembly including at least one axial bead punch over the center block forming at least one axial bead in a side wall of the cup and further forming the cup to have a second depth greater than the first depth and greater than a finished, third depth of the can body; and forming the cup to have a step shoulder; wherein forming the cup to have a step shoulder comprises: drawing metal from the inwardly tapering annular periphery of the cup; and collapsing the cup depth from the second cup depth to the third can body depth, metal drawn from the inwardly tapering annular periphery of the cup and collapsing the cup depth from the second cup depth to the third can body depth being sufficient to prevent the at least one axially extending side wall bead from extending into the step shoulder.

The inwardly tapering annular periphery of the closed end of the cup may comprise a defined thickness such as the thickness of the stock material used to form the cup. The inwardly tapering annular periphery of the closed end of the cup comprises a first portion adjacent to a side wall of the cup and a second portion adjacent to an end panel of the cup, and wherein the first and second portions are interconnected by a frusto-conical portion. The first portion has a first radius and the second portion has a second radius. While the first and second radii may be the same, the first and second radii may differ in size, for example the second radius may be smaller than the first radius. Collapsing the cup depth from the second cup depth to the third can body depth may further comprise trimming excess flange material from the can body.

A method of making a can body in accordance with another aspect of the invention of the present application may comprise providing a preform having a first depth and a closed end, the closed end of the preform having an inwardly tapering annular periphery; placing the preform on a center block having an end panel die; providing a punch assembly having a cavity for receiving the preform on the center block, the punch assembly having at least one bead punch in a sidewall of the cavity and an end panel punch; relatively moving the punch assembly and the center block so that the preform and center block are received in the cavity; relatively moving the punch assembly and the center block toward a bottomed position to draw the preform to form at least one bead in a sidewall thereof and to extend the first depth to a second depth greater than the first depth; and bottoming the punch assembly and the preform on the center block to form an end panel having a step shoulder by drawing material from the annular periphery of the preform and by collapsing the preform from the second depth to a third depth of the can body.

Having thus described the invention of the present application in detail and by reference to embodiments thereof, it will be apparent that modifications and variations are possible without departing from the scope of the invention defined in the appended claims.

The invention claimed is:

1. A method of making a can body having at least one axial rib and a bottom including a step shoulder, said method comprising:

placing a cup having a first depth and a closed end over a center block of a redraw die, said closed end of said cup having an inwardly tapering annular periphery that extends the depth of said cup to said first depth;

relatively moving a punch assembly including at least one axial bead punch over said center block in a single operation to:

form at least one axial bead in a side wall of said cup;

form said cup to have a second depth greater than said first depth and greater than a finished, third depth of said can body; and form said cup to have a step shoulder comprising:

drawing metal from said inwardly tapering annular periphery of said cup; and collapsing said cup depth from said second cup depth to said third can body depth, wherein a volume of metal at said inwardly tapering annular periphery of said cup is sufficient such that, during the single operation, said at least one axially extending side wall bead is prevented from extending into said step shoulder.

2. The method as claimed in claim 1 wherein said inwardly tapering annular periphery of said closed end of said cup comprises a defined thickness.

3. The method as claimed in claim 1 wherein said inwardly tapering annular periphery of said closed end of said cup comprises a first portion adjacent to a side wall of said cup and a second portion adjacent to an end panel of said cup, and wherein said first and second portions are interconnected by a frusto-conical portion.

4. The method as claimed in claim 3 wherein said first portion has a first radius and said second portion has a second radius.

5. The method as claimed in claim 4 wherein said second radius is smaller than said first radius.

6. The method as claimed in claim 5 wherein said inwardly tapering annular periphery of said cup comprises a defined thickness.

7. The method as claimed in claim 1 wherein collapsing said cup depth from said second cup depth to said third can body depth further comprises trimming excess flange from said can body.

8. The method as claimed in claim 1, wherein said volume of metal at said inwardly tapering annular periphery of said cup is determined using geometrical calculations based on a model of each can body to be produced.

9. The method as claimed in claim 8, wherein a shape of a corner of said closed end of said cup is determined for each can body to be produced based on:

a bottom panel of said step shoulder to be formed; and a material to be used to form the can body.

10. The method as claimed in claim 1, wherein said volume of metal at said inwardly tapering annular periphery of said cup is substantially undisturbed until said punch assembly is moved into a bottomed position.

11. The method as claimed in claim 1, wherein a side surface of said center block defines inner boundaries of said side wall of said can body.

12. A method of making a can body comprising:

providing a preform having a first depth and a closed end, said closed end of said preform having an inwardly tapering annular periphery;

placing said preform on a center block having an end panel die;

providing a punch assembly having a cavity for receiving said preform on said center block, said punch assembly having at least one axial bead punch in a sidewall of said cavity and an end panel punch;

relatively moving said punch assembly and said center block so that said preform and center block are received in said cavity;

relatively moving said punch assembly and said center block toward a bottomed position to draw said preform to form at least one bead in a sidewall thereof and to extend said first depth to a second depth greater than said first depth; and bottoming said punch assembly and said preform on said center block to form an end panel having a step shoulder by drawing material from said inwardly tapering annular periphery of said preform and by collapsing said preform from said second depth to a third depth of said can body, wherein a volume of metal at said inwardly tapering annular periphery of said preform is substantially undisturbed until the step of bottoming said punch assembly and said preform on said center block, and wherein said volume of metal is sufficient such that said at least one bead in said sidewall of said preform is prevented from extending into said step shoulder of said end panel during the step of bottoming said punch assembly and said preform on said center block.

13. The method as claimed in claim 12 wherein said inwardly tapering annular periphery of said closed end of said preform comprises a defined thickness.

14. The method as claimed in claim 12 wherein said inwardly tapering annular periphery of said closed end of said preform comprises a first portion adjacent to a side wall of said preform and a second portion adjacent to an end panel of said preform, and wherein said first and second portions are interconnected by a frusto-conical portion.

15. The method as claimed in claim 14 wherein said first portion has a first radius and said second portion has a second radius.

16. The method as claimed in claim 15 wherein said second radius is smaller than said first radius.

17. The method as claimed in claim 16 wherein said inwardly tapering annular periphery of said preform comprises a defined thickness.

18. The method as claimed in claim 12 wherein bottoming said punch assembly and said preform on said center block to form an end panel having a step shoulder further comprises trimming excess flange from said can body.

19. The method as claimed in claim 12, wherein a side surface of said center block defines inner boundaries of said sidewall of said can body.

20. The method as claimed in claim 12, wherein said inwardly tapering annular periphery extends the depth of said preform to said first depth.

* * * * *